US008881848B2

(12) United States Patent
Knull et al.

(10) Patent No.: US 8,881,848 B2
(45) Date of Patent: Nov. 11, 2014

(54) FIXED CUTTER DRILL BIT WITH ROTATING CUTTER DISC

(75) Inventors: Craig Knull, Edmonton (CA); Kevin Christenson, Millet (CA)

(73) Assignee: Ulterra Drilling Technologies, L.P., Fort Worth, TX (US)

( * ) Notice: Subject to any disclaimer, the term of this patent is extended or adjusted under 35 U.S.C. 154(b) by 268 days.

(21) Appl. No.: 13/465,162

(22) Filed: May 7, 2012
(Under 37 CFR 1.47)

(65) Prior Publication Data

US 2013/0292185 A1 Nov. 7, 2013

(51) Int. Cl.
*E21B 10/36* (2006.01)

(52) U.S. Cl.
USPC ..... 175/408; 175/431

(58) Field of Classification Search
USPC ..... 175/373, 408, 431
See application file for complete search history.

(56) References Cited

U.S. PATENT DOCUMENTS

| | | | | |
|---|---|---|---|---|
| 2,297,157 | A | 9/1942 | McClinton | |
| 4,751,972 | A * | 6/1988 | Jones et al. | 175/431 |
| 5,339,910 | A | 8/1994 | Mueller | |
| 5,456,329 | A | 10/1995 | Dennis et al. | |
| 7,819,208 | B2 | 10/2010 | Pessier et al. | |
| 7,841,426 | B2 | 11/2010 | Zahradnik et al. | |
| 2009/0272582 | A1 | 11/2009 | McCormick et al. | |
| 2010/0270085 | A1 | 10/2010 | Turner et al. | |
| 2010/0288561 | A1 | 11/2010 | Zahradnik et al. | |
| 2010/0320001 | A1 | 12/2010 | Kulkarni | |
| 2011/0079440 | A1 | 4/2011 | Buske et al. | |
| 2011/0079442 | A1 | 4/2011 | Buske et al. | |
| 2011/0079443 | A1 | 4/2011 | Buske et al. | |
| 2011/0079444 | A1 | 4/2011 | Kulkarni | |
| 2011/0259150 | A1 * | 10/2011 | Hall et al. | 76/115 |
| 2011/0259646 | A1 | 10/2011 | Hall et al. | |

FOREIGN PATENT DOCUMENTS

| | | |
|---|---|---|
| RU | 2006565 C1 | 1/1994 |
| RU | 2410521 C1 | 1/2011 |

OTHER PUBLICATIONS

International Search Report and Written Opinion received in corresponding Patent Cooperation Treaty Application No. PCT/US2013/040004, dated Sep. 12, 2013, 6 pages.

* cited by examiner

*Primary Examiner* — William P Neuder

(57) ABSTRACT

A fixed cutter drill bit that includes one or more integrally-mounted rotating disc with cutters around the circumference of the disc. Each disc is mounted to bearings to handle the torque generated and the weight on bit required to cut the formation. The mounting angle of the disc generates a torque causing the disc to rotate. As the disc rotates, new cutters are presented to the formation. The discs may vary in size, mounting location and number so as to cover entire bladed or just a certain portions of blades. The exposure of the disc could also be set to enable it to rotate while under load, e.g., the cutters on the outside of the bit may contact the formation while the inner half of the disc is protected by a fixed blade.

16 Claims, 8 Drawing Sheets

FIXED CUTTER DRILL BIT WITH ROTATING CUTTER DISC

BACKGROUND OF THE INVENTION

1. Field of the Invention

This invention relates generally to drill bits for use in drilling a borehole in a subterranean formation.

2. Background Art

Drill bits used to drill well bores through subterranean earth formations generally are made within one of two broad categories of bit structures. In the first category are the drill bits generally known as "roller cone" bits, which include a bit body having one or more roller cones rotatably mounted to the bit body. All known roller cone bits of prior art utilize cone or cylindrical bodies that rotate about a local axis that lies within a plane that is generally radial to the axis about which the drill bit rotates. The bit body is typically formed from steel or another high strength material. The roller cones are also typically formed from steel or other high strength material and include a plurality of teeth or cutting elements disposed at selected positions about the cones. The bit is secured to the lower end of a drill string that is rotated from the surface or by a down hole motor or turbine. The cutters mounted on the bit roll and slide upon the bottom of the borehole as the drill string is rotated, thereby engaging and crushing or disintegrating the formation material to be removed. The cutting elements on the rolling cutters are forced to penetrate and gouge the bottom of the borehole by weight of the drill string. The cuttings form the bottom and sides of the borehole are washed away by drilling fluid that is pumped down from the surface through the hollow, rotating drill string, and are carried in suspension in the drilling fluid to the surface.

Drill bits of the second category are typically referred to as "fixed cutter" or "drag" bits. A conventional fixed cutter drill bit has no moving elements but rather has a drill bit body typically having multiple blades, and cutters (sometimes referred to as cutter elements, cutting elements or inserts) attached at selected positions to the bit body or blades. The drilling mechanics and dynamics of a fixed cutter bit are different from those of roller cone bits. During drilling, fixed cutter bits are rotated against the subterranean formation being drilled under applied weight on bit to remove formation material. However, engagement between the cutting elements of a fixed cutter drill bit and the borehole bottom and sides shears or scrapes material from the formation, instead of using a crushing action as is employed by roller-cone bits.

The drill bit bodies to which cutting elements are attached in a fixed cutter drill bit may often be formed of steel or of molded tungsten carbide. Drill bit bodies formed of molded tungsten carbide (so-called matrix-type bit bodies) are typically fabricated by preparing a mold that embodies the inverse of the desired topographic features of the drill bit body to be formed. Examples of such topographic features include generally radially extending blades, sockets or pockets for accepting the cutting elements, junk slots, internal watercourses, nozzles and passages for delivery of drilling fluid to the bit face, ridges, lands, and the like. Tungsten carbide particles are then placed into the mold and a binder material, such as a metal including copper and tin, is melted or infiltrated into the tungsten carbide particles and solidified to form the drill bit body. Steel drill bit bodies, on the other hand, are typically fabricated by machining a piece of steel to form the desired external topographic features of the drill bit body. In both matrix-type and steel bodied drill bits, a threaded pin connection may be formed for securing the drill bit body to the drive shaft of a down hole motor or directly to drill collars at the lower end of a drill string rotated at the surface by a rotary table or top drive.

The cutting elements in a fixed cutter drill bit may be formed having a substrate or support stud made of carbide, for example tungsten carbide, and an ultra-hard cutting surface layer or "table" made of a polycrystalline diamond material or other super-abrasive material deposited onto or otherwise bonded to the substrate at an interface surface. One type of ultra-hard cutting surface for a fixed cutter bit is a layer of polycrystalline diamond formed on a substrate of tungsten carbide, typically known as polycrystalline diamond compact (PDC). Cutting elements are typically attached to matrix-type and steel bodied drill bits by either brazing or press-fitting the cutting elements into recesses or pockets formed in the bit face or in blades extending from the face. The cutting elements are attached to the bit bodies in this manner to ensure sufficient cutting element retention, as well as mechanical strength sufficient to withstand the forces experienced during drilling operations.

However, conventional fixed cutter drill bits having conventionally attached cutting elements suffer from a number of drawbacks and disadvantages. Because the cutting element is affixed to the bit body, only a portion of the circumferential cutting edge of the cutting element actually engages the subterranean formation being drilled. The constant engagement between this select portion of the cutting edge and the formation tends to quickly degrade and wear down the engaged portion of the cutting edge, resulting in decreased cutting element life, drilling efficiency, and accuracy. This constant engagement also significantly increases the temperature of the cutting element, which may further result in increased wear and/or potential destruction of the cutting element and drill bit body.

Many cutters develop cracking, spalling, chipping and partial fracturing of the ultra-hard material cutting layer at a region of cutting layer subjected to the highest loading during drilling. This region, often referred to as the "critical region," encompasses the portion of the ultra-hard material layer that makes contact with the earth formations during drilling. The critical region is subjected to high magnitude stresses from dynamic normal loading, and shear loadings imposed on the ultra-hard material layer during drilling. Because the cutters are typically inserted into a drag bit at a rake angle, the critical region includes a portion of the ultra-hard material layer near and including a portion of the layer's circumferential edge that makes contact with the earth formations during drilling.

Additionally, another factor in determining the longevity of PDC cutters is the generation of heat at the cutter contact point, specifically heat generated from friction where the PDC layer is exposed to the formation. This heat causes thermal damage to the PDC in the fowl of cracks which lead to spalling of the polycrystalline diamond layer, delamination between the polycrystalline diamond and substrate, and back conversion of the diamond to graphite causing rapid abrasive wear. The high magnitude stresses at the critical region alone or in combination with other factors, such as residual thermal stresses, can result in the initiation and growth of cracks across the ultra-hard layer of the cutter. Cracks of sufficient length may cause the separation of a sufficiently large piece of ultra-hard material, rendering the cutter ineffective or resulting in the failure of the cutter. The high stresses, particularly shear stresses, may also result in delamination of the ultra-hard layer at the interface.

Bit designs in which one or more fixed cutters are individually rotatable are not an effective solution. An individual bit is subject to the same mechanical and thermal stresses described above. Further, it is very challenging to preserve the structural integrity of any small piece, such as an individual fixed cutter, under these extreme mechanical and thermal stresses.

In some fixed cutter bits, PDC cutters are fixed onto the surface of the bit such that a common cutting surface contacts the formation during drilling. Over time and/or when drilling certain hard but not necessarily highly abrasive rock formations, the edge of the working surface that constantly contacts the formation begins to wear down, forming a local wear flat, or an area worn disproportionately to the remainder of the cutting element. Local wear flats may result in longer drilling times due to a reduced ability of the drill bit to effectively penetrate the work material and a loss of rate of penetration caused by dulling of edge of the cutting element. That is, the worn cutter acts as a friction bearing surface that generates heat, which accelerates the wear of the cutter and slows the penetration rate of the drill. Such flat surfaces effectively stop or severely reduce the rate of formation cutting because the conventional cutters are not able to adequately engage and efficiently remove the formation material from the area of contact.

The failure conditions described above require expensive and time-consuming repair measures. Drilling operations may have to be ceased to allow for recovery and/or replacement of the drill bit and/or replacement of the ineffective or failed cutters.

IDENTIFICATION OF OBJECTS OF THE INVENTION

A primary object of the invention is to provide a drill bit having prolonged life.

SUMMARY OF THE INVENTION

The objects described above and other advantages and features of the invention are incorporated in a fixed cutter drill bit that includes one or more integrally-mounted rotating disc with cutters around the circumference of the disc. Each disc is mounted to bearings to handle the torque generated and the weight on bit required to cut the formation. The mounting angle of the disc generates a torque causing the disc to rotate. As the disc rotates, new cutters are presented to the formation. The discs may vary in size, mounting location and number so as to cover entire bladed or just a certain portions of blades. The exposure of the disc could also be set to enable it to rotate while under load, e.g., the cutters on the outside of the bit may contact the formation while the inner half of the disc is protected by a fixed blade.

BRIEF DESCRIPTION OF THE DRAWINGS

The invention is described in detail hereinafter on the basis of the embodiments represented in the accompanying figures, in which.

DESCRIPTION OF THE PREFERRED EMBODIMENT OF THE INVENTION

In one embodiment of this invention, one or more blades of a fixed cutter drill bit include an integrally-mounted rotating disc with cutters around the circumference of the disc. This disc is mounted to bearings to handle the torque generated and the weight on bit required to cut the formation. The angle the disc is mounted at will generate a torque on the disc causing it to rotate around. As it rotates around new cutters are presented to the formation. This disc could vary in size to cover the entire blade or just a certain portion of the blade, preferably the shoulder area of the bit profile where the cutters generally do most work. The exposure of the disc could also be set to enable it to rotate while under load, i.e. the cutters on the outside of the bit may contact the formation while the inner half of the disc is protected by a fixed blade.

Figure 1:
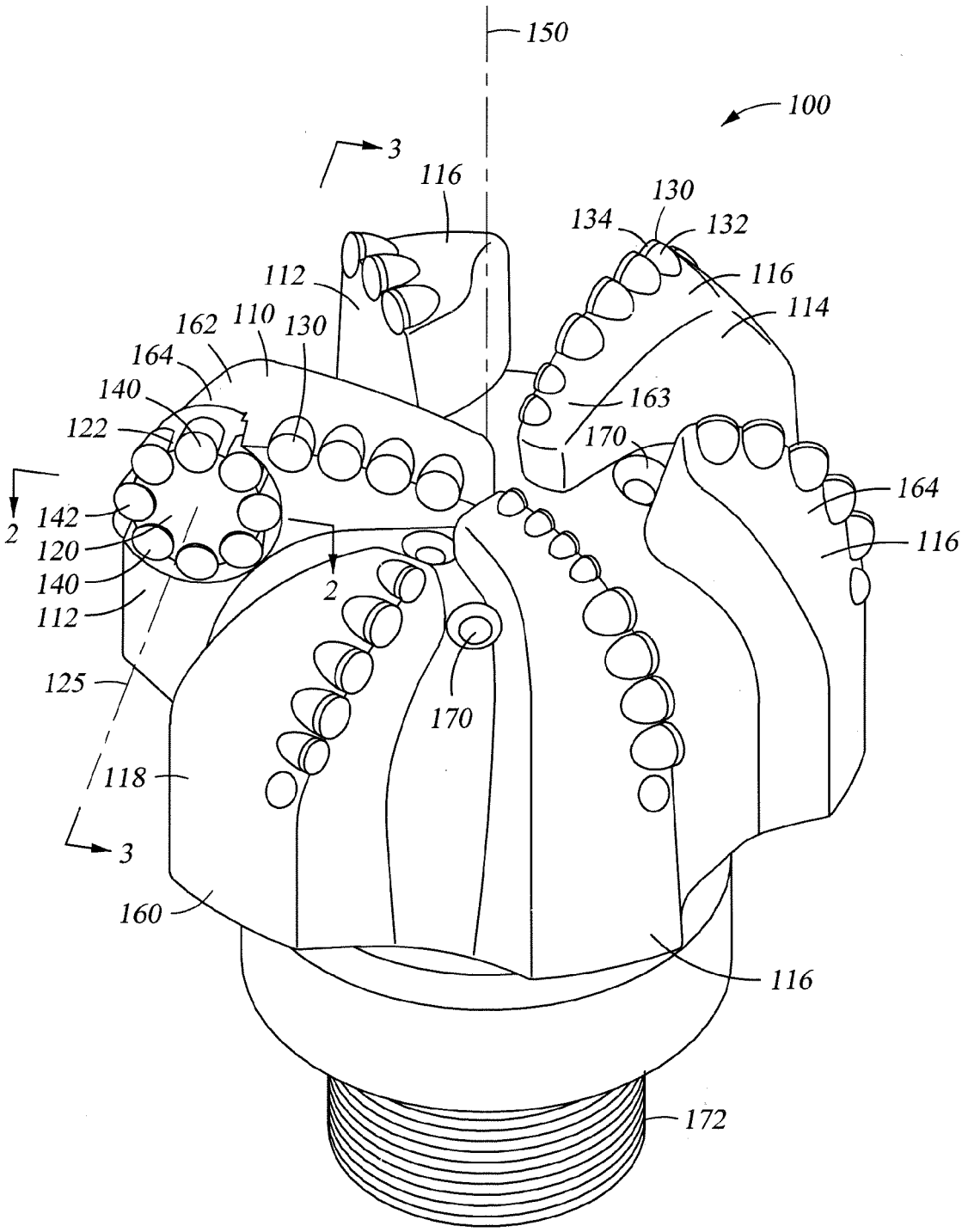
FIG. 1 is a perspective view of an exemplary fixed cutter drill bit according to a first embodiment of the invention, showing a cutter disc with cutters rotatively mounted to a blade.

FIG. 1 depicts an exemplary embodiment of a drill bit 100. Drill bit 100 generally represents any number of earth-boring or drilling tools, including, for example, fixed cutter drill bits, reamers, hole openers, hybrids, and eccentric tools and any other hole-making tools. As will be known to those of skill in the art, drill bit 100 may be formed in any number of ways and of any number of materials, including steel or of molded tungsten carbide, or a matrix-type bit body. In an embodiment, drill bit 100 and blades 110, 116 and 118 may be machined from steel or may be molded tungsten carbide, for example a matrix-type bit body.

In at least one embodiment, drill bit 100 comprises a plurality of radially and longitudinally extending blades 110, 116 and 118 defining a leading edge for drilling into a subterranean structure. Circumferentially adjacent blades, for example blades 110 and 118, may define one or more junk slots therebetween for channeling formation cuttings away from leading face 112 of blade 110.

Each blade 110 comprises a plurality of fixed cutters 130. A fixed cutter can be any cutting element known to the art capable of cutting a subterranean formation. An exemplary embodiment of a fixed cutter 130 comprises a substrate 132 and a table 134. Table 134 may be formed of any number of materials used for cutting formations, including, for example, an ultra-hard or super-abrasive material such as polycrystalline diamond or polycrystalline diamond compact (PDC). Other ultra-hard or super-abrasive materials that can be used in a fixed cutter in an embodiment include thermally-stable diamond having thermal stability greater than conventional PDC, a diamond-silicon carbide composite, polycrystalline cubic boron nitride, polycrystalline cubic boron nitride and polycrystalline diamond, or any other super-abrasive material. Similarly, substrate 132 may comprise any number of materials capable of adequately supporting a super-abrasive material during drilling of a subterranean formation, including, for example, cemented Tungsten Carbide (TC). In an embodiment, fixed cutter 130 is a PDC cutter. Fixed cutters 130 preferably are mounted to blade 110 by brazing. In alternative embodiments, fixed cutters may be mounted to blade 110 by threading or other mechanical means, adhesive, welding or press fit (or interference fit or friction fit).

Cutter disc 120 is mounted to blade 110 so that cutter disc 120 rotates around an axis of cutter disc rotation 125. Although the orientation of axis 125 may vary slightly up, down, in, or out, as described below, axis 125 is substantially perpendicular to a radial from the axis about which the drill bit rotates. In other words, in contrast to a conventional roller cone of prior art, cutter disc axis 125 may vary slightly from but is substantially tangent to the circumference of an imaginary circle centered about the drill bit axial centerline. Cutter disc 120 preferably is disposed in shoulder 164 of blade 110. In an exemplary embodiment, cutter disc 120 comprises a plurality of fixed cutters 140 and 142 disposed around the circumference of the cutter disc 120. Preferably each fixed cutter 140 and 142 is a PDC cutter. In an alternative embodiment, fixed cutters 140 can be a different type of cutter from fixed cutters 142. In another embodiment, fixed cutters 140, 142 can be a different type of cutter from fixed cutters 130. Different types of cutters, in embodiments, may include different types or shapes of PDC cutters, cutters having non-planar tables or tables having surface alterations, or cutters having tables comprising other ultra-hard or super-abrasive materials other than or in addition to PDC.

In operation, drill bit 100 rotates in a counter-clockwise direction around axis of drilling rotation 150. Drill bit 100 comprises API connection 172 for connection to a drill string (not shown), nozzles 170, nose 162, cone 163, and gauge pad 160. Each blade comprises a leading face 112 and a back side 114.

Figure 2:
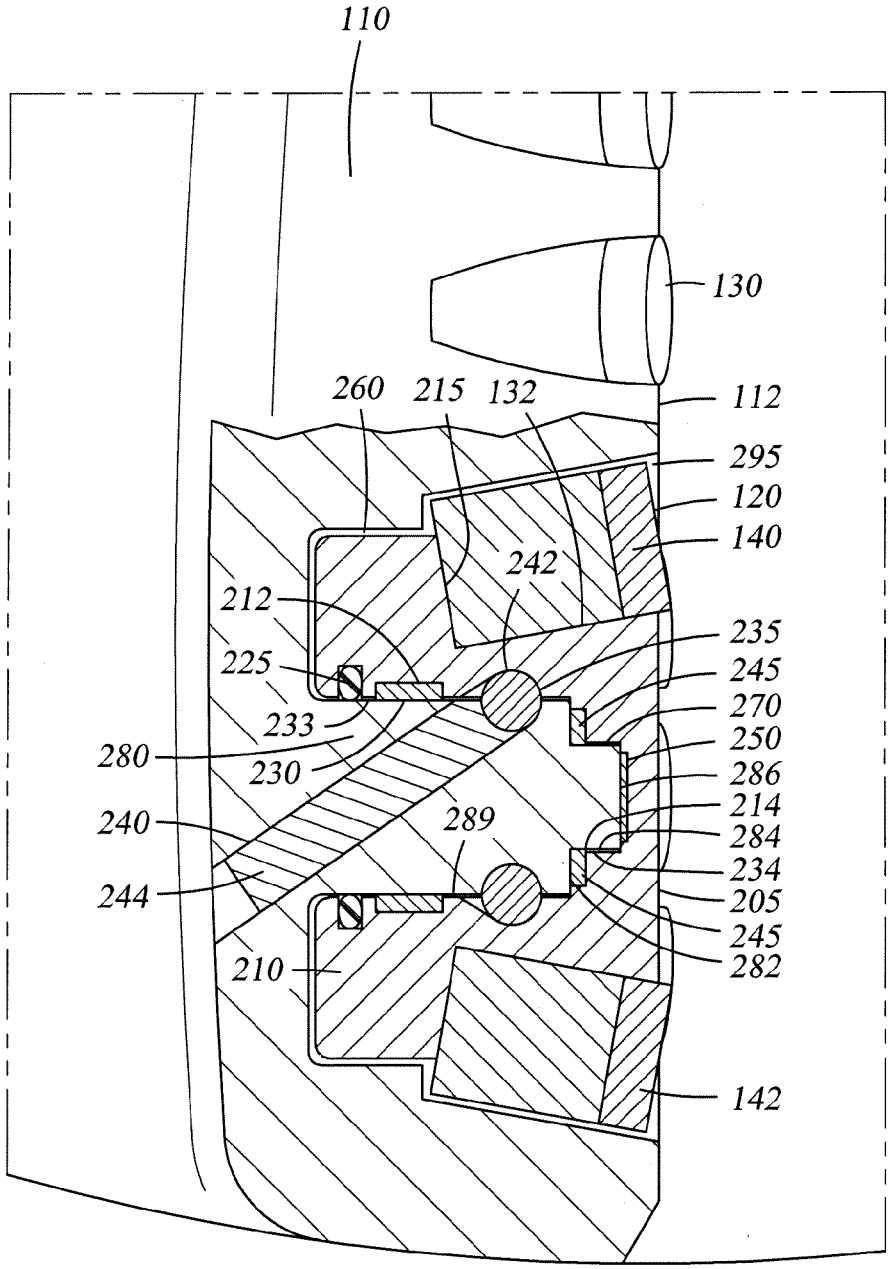
FIG. 2 is a plan view of a portion of the bit face of the cutter drill bit of FIG. 1, showing a blade with a broken-out section taken along lines 2-2 of FIG. 1 to reveal the structure of an exemplary cutter disc.

FIG. 2 depicts a broken-out cross-sectional view of cutter disc 120 taken along lines 2-2 of FIG. 1. Socket 260 in blade 110 has opening 295 in leading face 112 of blade 110. Stepped shaft 280 is centered in cavity 260. In an embodiment, stepped shaft 280 is integral with blade 110. In an embodiment, stepped shaft 280 is made of the same material as blade 110. In an embodiment, stepped shaft 280 comprises one or more coatings 289 comprising any hard metal or load-bearing-related coating.

Cutter disc 120 is inserted into socket 260 with counterbore 270 journaled onto shaft 280. Radial support for cutter disc 120 is provided by ball bearings 235, by plain bushings/bearings 230, on lower shaft side edge 233, and by plain bushings/bearings 234, on upper shaft side edge 284. In an embodiment, plain bushings/bearings 230 and 234 are mounted, affixed or otherwise disposed on the inner surfaces 212, 214 of cutter disc 120. Other configurations are possible. For example, in another embodiment, plain bushings/bearings 230, 234 are mounted, affixed or otherwise disposed on shaft 280. Ball bearings 235 are inserted into bearing race 242 through shaft 240. Plug 244 inserted into shaft 240 prevents the escape of ball bearings 235. Axial support for cutter disc 120 is provided by thrust washer 245, captured between shaft shoulder 282 and an inner surface of cutter disc 120, and bearing journal 250, captured between shaft end 286 and an inner surface of cutter disc 120. The bearing assemblies are protected from mud and drilling debris in an embodiment by O-ring seal 225. In an alternative embodiment a radial shaft seal or lip-type seal may be used in place of or in addition to O-ring seal 225.

Cutter disc 120 can be made of steel or tungsten carbide or matrix. In an embodiment cutter disc 120 is made of steel. Fixed cutters 140 and 142 are disposed in cavities 132 in cutter disc body 210 of cutter disc 120. Those of ordinary skill in the art will understand that multiple fixed cutters, the exact number depending on the size of the disc and the cutters, may be disposed in a cutter disc 120, and that fixed cutters 140 and 142 are intended to be exemplary rather than limiting. Fixed cutters 140 and 142 are secured to cutter disc 120 in an embodiment by brazing. In alternative embodiments, fixed cutters 140, 142 may be disposed in or secured to cutter disc 120 by threading or other mechanical means, adhesive, welding or press fit (or interference fit or friction fit). In an alternative embodiment, cutter disc 120 also includes one or more impact arresters or load limiters for load stability.

Cutter disc 120 has a planar disc face 205. In an embodiment, disc face 205 is angled with respect to the cutting plane defined by leading edge 112 of blade 110. As described in more detail below, the angle at which cutter disc 120 is mounted at will generate a torque on the disc causing it to rotate around axis of cutter rotation 125. As cutter disc 120 rotates, new cutters 140, 142 are presented to the formation. In an embodiment, cutter disc 120 is mounted to blade 110 so that at any time, the cutters on substantially one quarter (ninety degrees) of planar disc face 205 are presented to the formation. Thus, in an embodiment in which cutter disc 120 comprises twelve (12) fixed cutters spaced equally around the circumference of disc face 122, at any time all or part of four, more or less, contiguous fixed cutters will be exposed to the formation. As cutter disc 120 rotates, different cutters will rotate into engagement with the formation, but the number of cutters that engage the formation preferably will remain more or less constant. An additional benefit of this approach is that, as cutter disc 120 rotates, it will expose to the formation different sections of the table of each fixed cutter 140, 142 on cutter disc 120, so that the wear pattern will be distributed over a larger portion of the table of each cutter and more of the cutter edge will be used.

Figure 3:
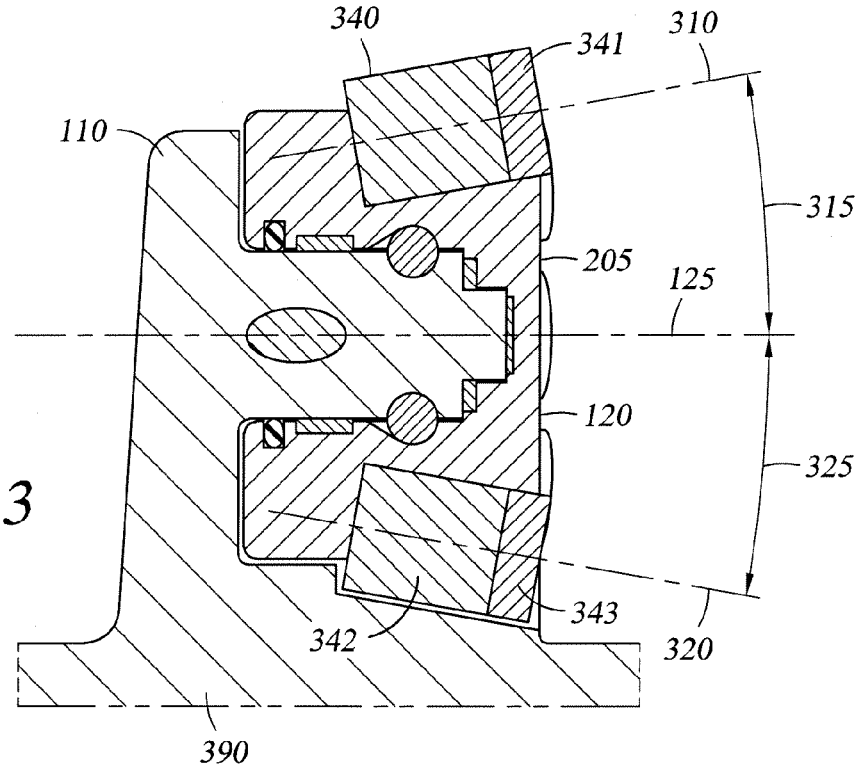
FIG. 3 is a cross-section taken along line 3-3 of FIG. 1 of a portion of the cutter drill bit of FIG. 1, showing the structure of an exemplary cutter disc.

FIG. 3 is a cross-sectional view taken along lines 3-3 of FIG. 1 of an embodiment comprising blade 110, blade root 390 and cutter disc 120. Cutter disc 120 is mounted on blade 110 and includes fixed cutters 340 and 342 with tables 341, 343. Fixed cutter 340 is centered on axis 310, and fixed cutter 342 is centered on axis 320. In an embodiment depicted in FIG. 3, axis of cutter rotation 125 of cutter disc 120 is oblique to axis 310 and oblique to axis 320, so that fixed cutters 340 and 342 are each similarly angled in relation to axis of cutter disc rotation 125. Preferably the angle of fixed cutters 340, 342 in relation to axis of cutter disc rotation 125 is 0 to 30 degrees.

Figure 4:
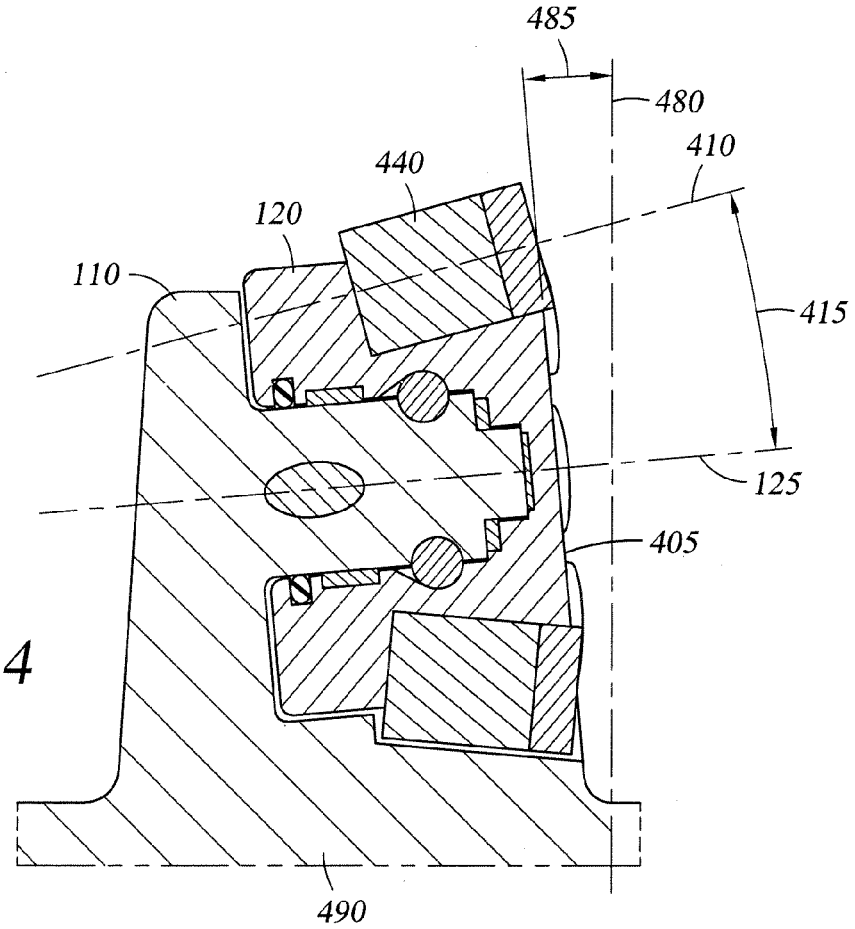
FIG. 4 is a cross-section taken along line 3-3 of FIG. 1 of a portion of the cutter drill bit of FIG. 1 according to an alternative embodiment, showing the structure of an exemplary cutter disc mounted on the blade so that operable cutters have a desired back rake angle.

FIG. 4 is a cross-sectional view taken along lines 3-3 of FIG. 1 of an alternative embodiment comprising blade 110, blade root 490 and cutter disc 120. In this alternative embodiment, cutter disc 120 is mounted on blade 110 and includes fixed cutter 440. Fixed cutter 440 is centered on axis 410. Axis 410 is oblique to axis of cutter disc rotation 125. In addition, cutter disc 120 is mounted on blade 110 so that cutter disc face 405 has a back rake with a rake angle 485 with respect to a line parallel to bit axis 150 (FIG. 1) of between 0 and −30 degrees in an embodiment. Cutter disc 120 may also be mounted so that the cutter disc face has a forward rake of between 0 and 30 degrees, as discussed below with respect to FIG. 14.

Figure 9:
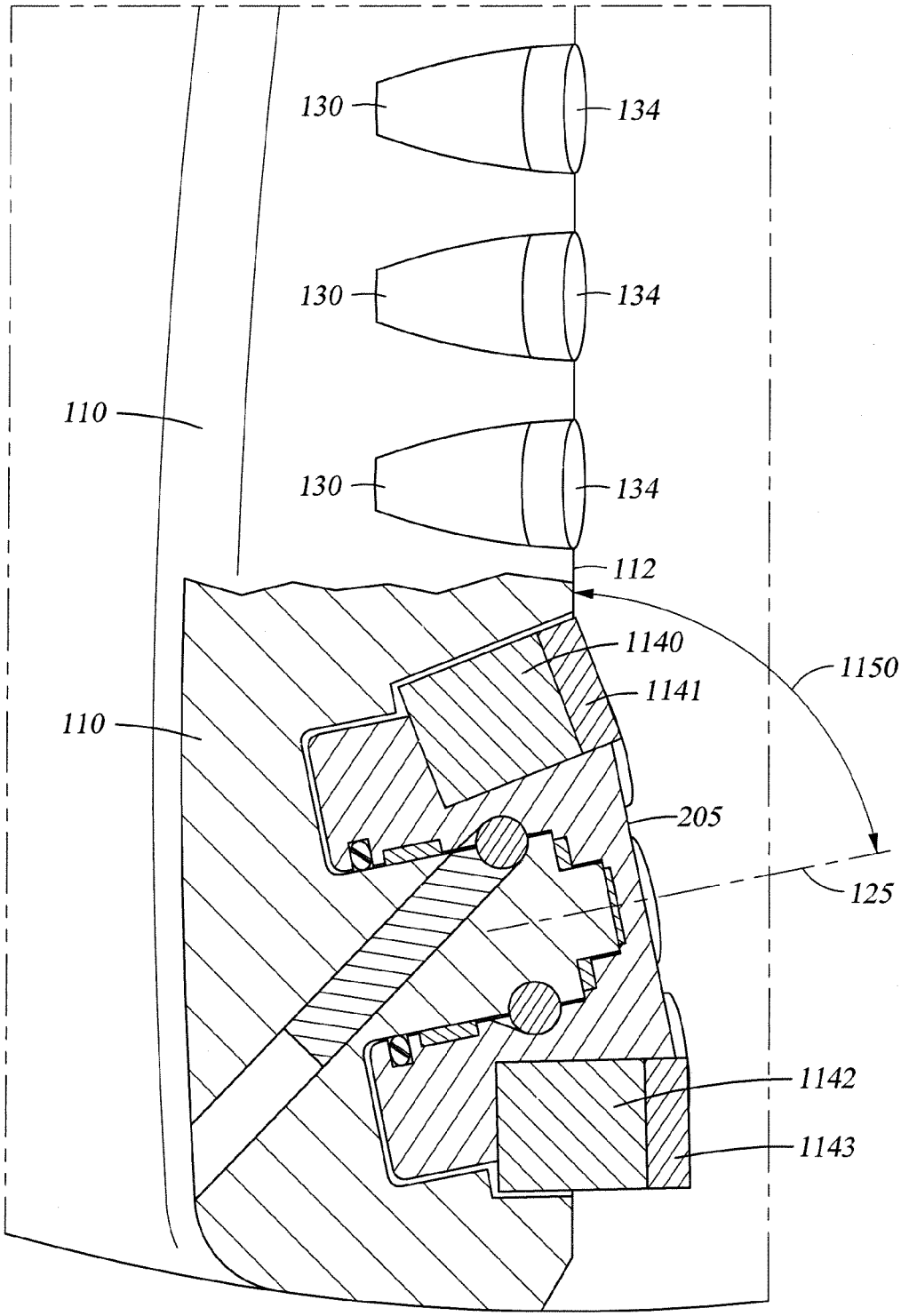
FIG. 9 is a plan view a portion of the bit face of a cutter drill bit according to an alternate embodiment of the invention with a broken-out section in the same manner as that of FIG. 2, showing an inward-facing rotatable cutter disc.

FIG. 9 is a partial cross-sectional view, not drawn to scale, taken along lines 2-2 of FIG. 1 of blade 110 and cutter disc 120. Blade 110 includes fixed cutters 130, each with table 134, and cutter disc 120, which includes fixed cutters 1140, 1142 with diamond tables 1141, 1143. Fixed cutters 1140 and 1142 are disposed on circumferentially-opposite sides of planar disc face 205, and fixed cutter 1142 is on the outside shoulder of blade 110, farther from the nose of the drill bit than fixed cutter 1140. In an embodiment, cutter disc 120 is mounted to blade 110 at a negative side rake of between 1 and 30 degrees. In other words, the angle 1150 between cutter disc angle of rotation 125 and the plane defined by leading edge 112 of blade 110 is between 60 and 89 degrees. In alternative embodiments, cutter disc 120 may have no side rake or a positive side rake. In a preferred embodiment, angle 1150 is larger than 90 degrees and may be up to 120 degrees, for example.

The cutter disc is mounted to the blade at an angle so that torque created by drilling forces will causing the cutter disc to rotate. As blade 110 is rotated in a counterclockwise manner during drilling to engage the formation (not shown), fixed cutter 1142 contacts the formation (not illustrated) before fixed cutters 1140 and 130. Because cutter disc 120 is mounted at an angle on blade 110, the force exerted on cutter disc 120 and fixed cutter 1142 by the rotation of the drill bit and the force exerted on the drill bit by the weight of the drill string (not illustrated), and the counterforce of the formation, will cause cutter disc 120 to rotate counter-clockwise. As cutter disc 120 rotates, new cutters are presented to the formation.

Figure 13:
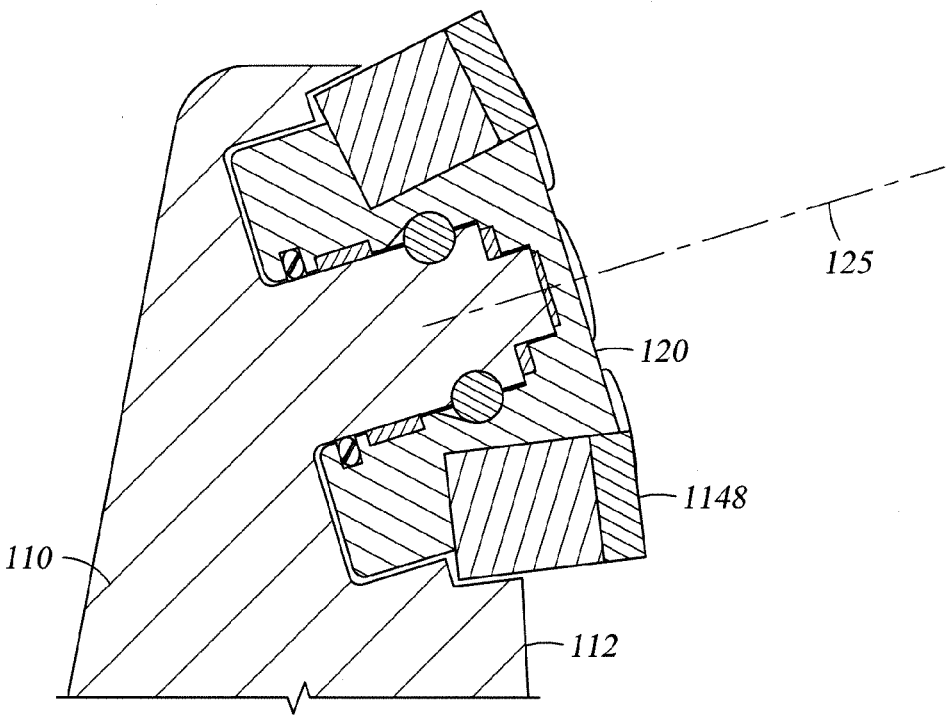
FIG. 13 is a cross-section taken along line 3-3 of FIG. 1 of a portion of the cutter drill bit of FIG. 1 according to an alternative embodiment, showing the structure of an exemplary cutter disc mounted on the blade so that the cutters closest to the bit body protrude outward from the blade.
Figure 14:
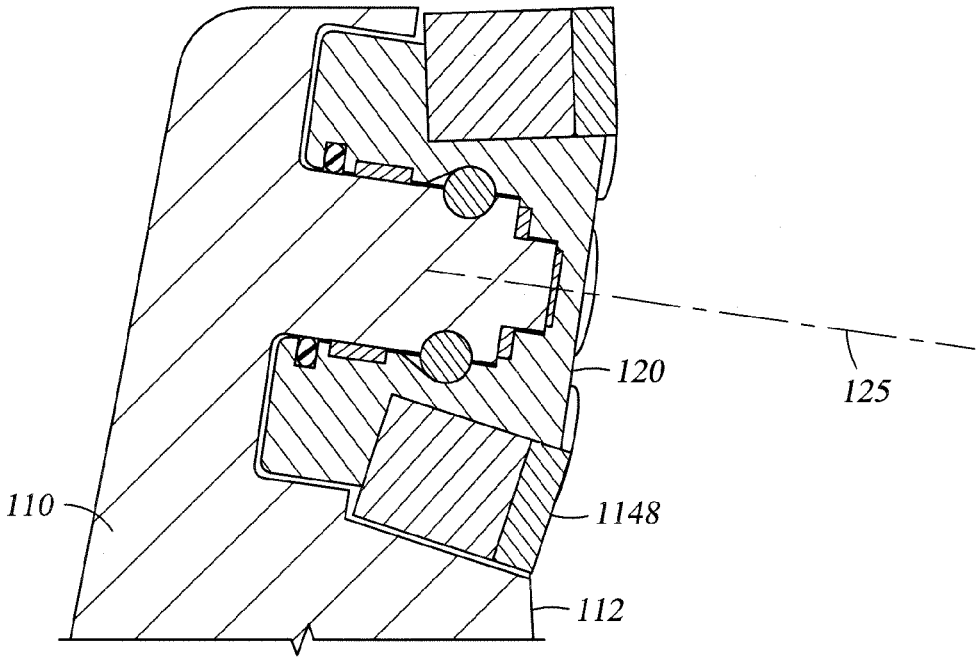
FIG. 14 is a cross-section taken along line 3-3 of FIG. 1 of a portion of the cutter drill bit of FIG. 1 according to an alternative embodiment, showing the structure of an exemplary cutter disc mounted on the blade that operable cutters have a desired forward rake angle.

FIG. 13 is a cross-sectional view taken along lines 3-3 of FIG. 1 of blade 110 and cutter disc 120. In FIG. 15, cutter disc 120 is angled at a back rake in relation to leading blade face 112 so that so that cutting element 1148 on the cutter disc 120 that is closest to the bit body contacts the subterranean formation before the other fixed cutters on the disc. In this embodiment, the back rake angle ranges from 0 to 20 degrees. FIG. 14 is a cross-sectional view taken along lines 3-3 of FIG. 1 of another embodiment in which cutter disc 120 is angled at a forward rake of between 0 to 20 degrees in relation to leading blade face 112. In alternative embodiments cutter disc 120 may be angled in any two dimensions relative to leading face 112 of blade 110. As with the embodiment shown in FIG. 9, the force exerted by the rotation of the drill bit, the weight of the drilling string and the counterforce force of the formation on the foremost fixed cutter on cutter disc 120 causes cutter disc 120 to rotate thereby continuously presenting a new cutter face to the formation.

Figure 5:
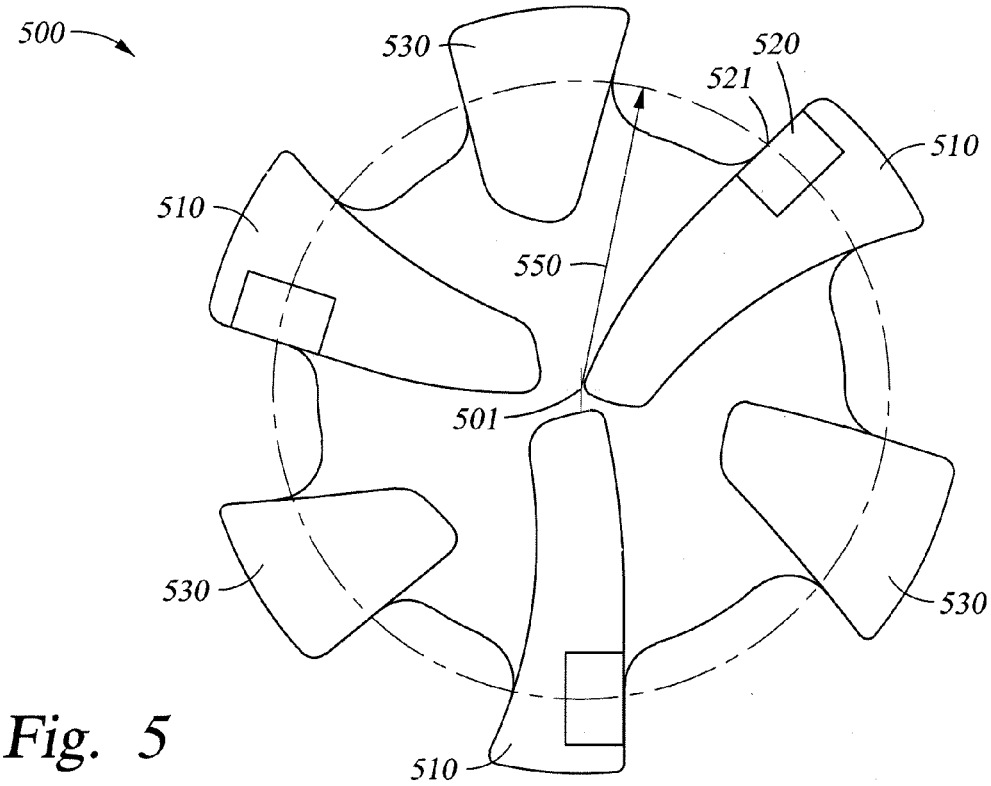
FIG. 5 is a simplified plan view of the bit face of a cutter drill bit according to an alternative embodiment, showing a configuration of multiple blades having revolvable cutter discs intervaled by blades having no cutter discs.

FIG. 5 depicts a configuration of cutter discs and blades according to another embodiment. Drill bit 500 in FIG. 5 comprises blades 510 and 530. Between each pair of blades 510 is a blade 530, and between each pair of blades 530 is a blade 510. Each blade 510 includes a cutter disc 520. Each cutting disk 520 is mounted to blade 510 so that the radial distance 550 from the center 501 of drill bit 500 to the axial center 521 of cutter disc 520 is the same for each blade 510 and cutter disc 520. Other numbers of blades and cutter discs, and other arrangements (e.g. cutter discs intervaled every second or third blade, asymmetrical layouts, etc.) of cutter discs may be used as appropriate.

Figure 6:
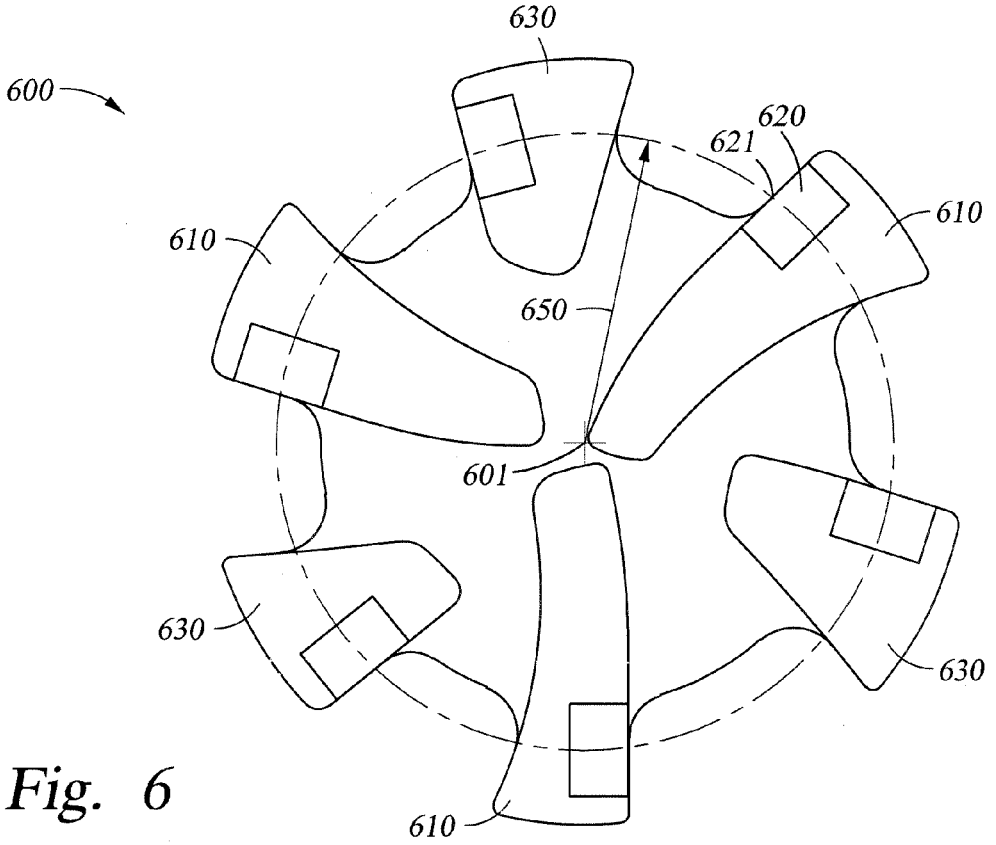
FIG. 6 is a simplified plan view of the bit face of a cutter drill bit according to an alternative embodiment, showing a drill bit configuration wherein every blade includes a revolvable cutter disc.

FIG. 6 depicts a configuration of cutter discs and blades according to another embodiment. Drill bit 600 comprises three blades 610 and three blades 630, and each blade 610, 630 includes a cutter disc 620. Each cutting disk 620 is mounted to blades 610, 630 so that the radial distance 650 from the center 601 of drill bit 600 to the axial center 621 of cutter disc 620 is the same for each blade 610, 630 and cutter disc 620. Other numbers of blades may be used as appropriate.

Figure 7:
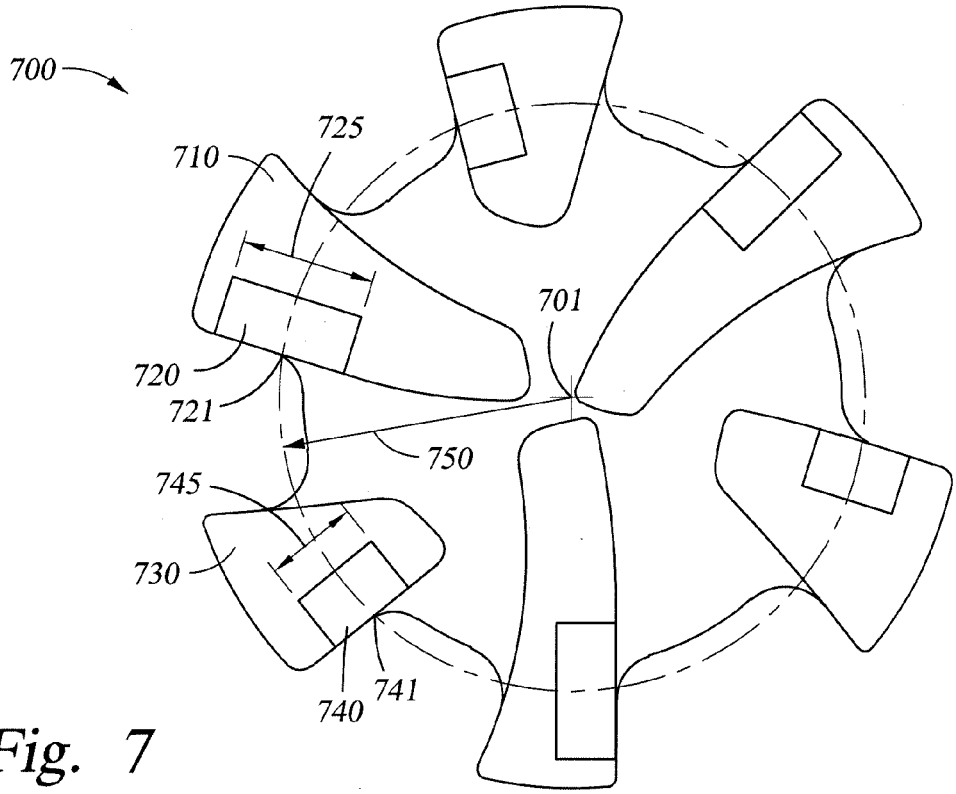
FIG. 7 is a simplified plan view of the bit face of a cutter drill bit according to an alternative embodiment, showing a drill bit configuration including revolvable cutter discs of differing diameters.

Embodiments of the invention include different size cutter discs. FIG. 7 depicts a configuration of cutter discs and blades according to another embodiment. Drill bit 700 comprises blade 710 with cutter disc 720. Drill bit 700 also comprises blade 730 with cutter disc 740. The diameter 725 of cutter disc 720 is greater than the diameter 745 of cutter disc 740. In the embodiment shown in FIG. 7, cutter disc 720 and cutter disc 740 each share the same radial distance 750 between drill bit center 701 and axial centers 721, 741. In alternative embodiments, other blades in drill bit 700 comprise one or more cutter discs having a different size or a different distance from the radial center of the drill bit.

Figure 8:
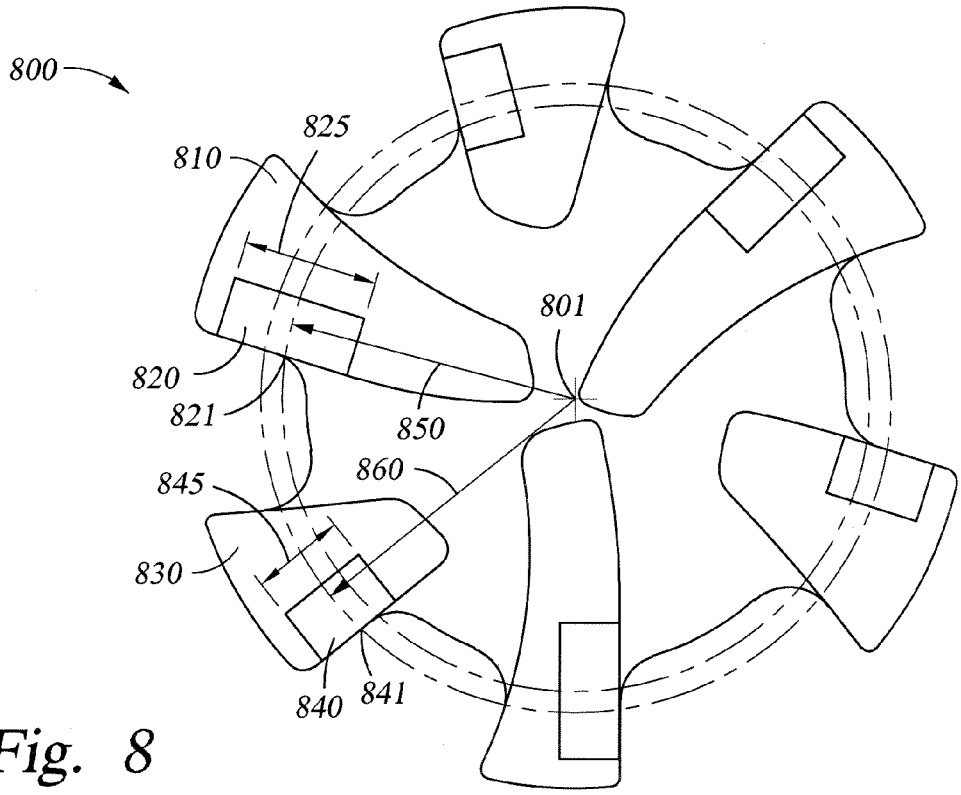
FIG. 8 is a simplified plan view of the bit face of a cutter drill bit according to an alternative embodiment, showing a drill bit configuration wherein revolvable cutter discs are mounted at differing radii from the drill bit centerline.

Alternative embodiments of the invention include cutter discs (of the same or different diameters) located at radially different distances from the center of the drill bit. Drill bit 800 depicted in FIG. 8 comprises blades 810 with cutter discs 820, and blades 830 with cutter discs 840. The diameter 825 of cutter disc 820 is greater than the diameter 845 of cutter disc 840, although the diameters may be the same if desired. The radial distance 850 from the center 801 of drill bit 800 to the axial center 821 of cutter disc 820 is less than the radial difference 860 from the center 801 of drill bit 800 to the axial center 841 of cutter disc 840. In an embodiment a similar arrangement of blades 810, 830 and cutter discs 820, 840 is repeated in all blades of drill bit 800. The scope of the invention includes any configuration of numbers of cutter discs, sizes of the cutter discs, and radial distance of the cutter discs from the center of the drill bit.

Figure 10:
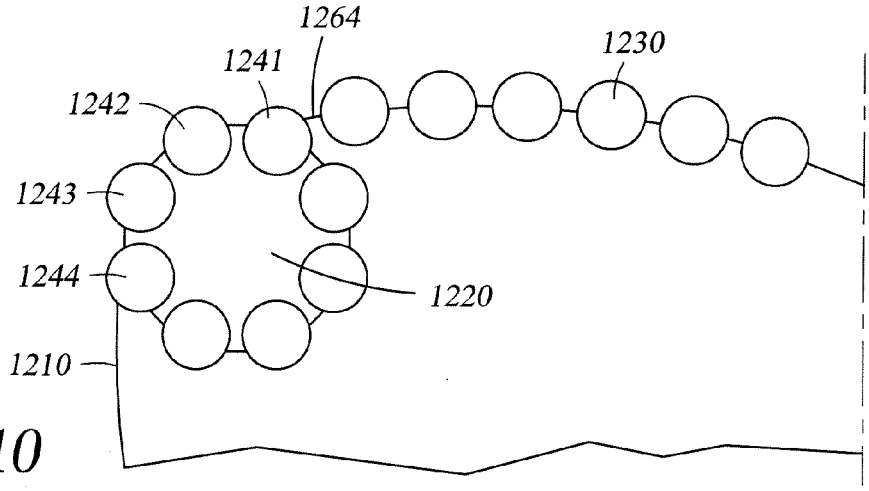
FIG. 10 is a simplified elevation of a blade of a cutter drill bit according to a first embodiment of the invention, showing a rotatable cutter disc located in the shoulder region of the bit.
Figure 11:
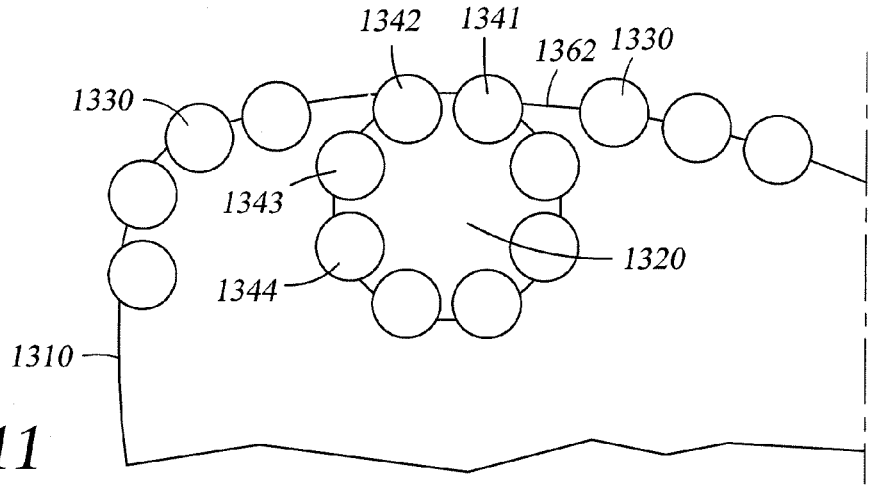
FIG. 11 is a simplified elevation of a blade of a cutter drill bit according to a second embodiment of the invention, showing a rotatable cutter disc located at the nose region of the bit.
Figure 12:
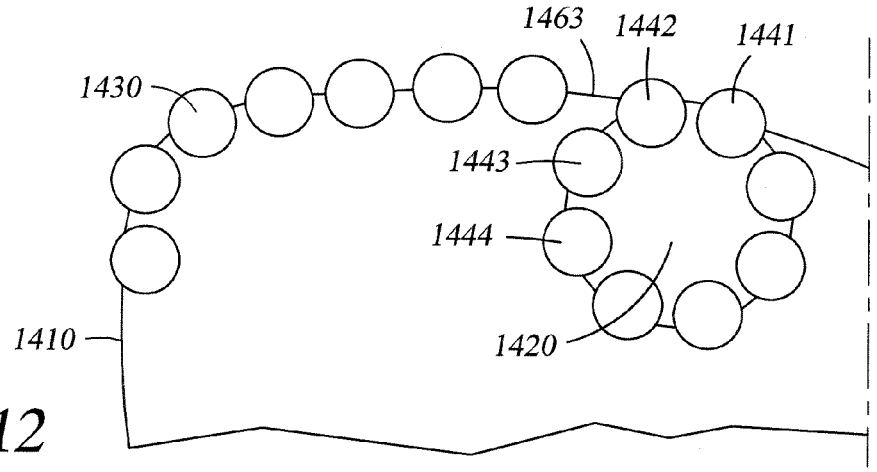
FIG. 12 is a simplified elevation of a blade of a cutter drill bit according to a third embodiment of the invention, showing a rotatable cutter disc located in the cone region of the bit.

FIGS. 10-12 depict alternative embodiments in which the cutter disc is mounted to different locations on the blade. FIG. 10 depicts cutter disc 1220 mounted to shoulder 1264 of blade 1210. In the embodiment shown in FIG. 10, cutter disc 1220 comprises twelve fixed cutters, and at any time the fixed cutters in the position of fixed cutters 1241, 1242, 1243 and 1244 are the only cutters exposed to the formation. FIG. 11 depicts cutter disc 1320 mounted to nose 1362 of blade 1310. In the embodiment shown in FIG. 11, cutter disc 1320 comprises twelve fixed cutters, and at any time the fixed cutters in the position of cutters 1341, 1342, 1343 and 1344 are the only cutters exposed to the formation. FIG. 12 depicts cutter disc 1420 mounted to cone 1463 of blade 1410. In the embodiment shown in FIG. 12, cutter disc 1420 comprises twelve fixed cutters, and at any time the four cutters 1441, 1442, 1443 and 1444 are the only cutters exposed to the formation. Additional alternative configurations (not shown) includes a drill bit blade in which the cutter disc covers the entire portion of the blade that is exposed to the formation. In other alternative embodiments (not shown), the drill bit may have cutter discs disposed on different locations on one or more blades, so that, for example, a drill bit having six blades may include a cutter disc mounted to the shoulder of two blades, a cutter disc mounted to the nose of the drill bit on two other blades, and no cutter discs at all in two other blades. Any drill bit configuration comprising one or more blades with cutter discs, one or more blades without cutter discs, and any configuration of cutter discs on the blade is within the scope of the invention.

An improved down-hole tool such as a fixed cutter drill bit having a rotating cutter disc with cutters that become active at different times provides several significant benefits. A new sharp cutter is presented to the rock at different times to keep the penetration rate high on the bit. In addition, the length of the bit run will be extended due to the increased amount of sharp cutting edge exposed to the formation. As the cutter disc rotates, the critical region of each individual fixed cutter on the cutter disc that is exposed to the formation will change, and a greater percentage of the cutting surface on the table of each individual cutter on the disc will be available for shearing and scraping. Also, because different fixed cutters are exposed to the formation at any given time, the cumulative thermal stress on each individual fixed cutter on the cutter disk due to friction will be diminished, thereby diminishing the likelihood of cracking and failure of the individual cutter bit. Further, the use of the fixed cutter disc can prevent local wear flats by constantly exposing a fresher cutting surface to the formation.

The Abstract of the disclosure is written solely for providing the United States Patent and Trademark Office and the public at large with a way by which to determine quickly from a cursory reading the nature and gist of the technical disclosure, and it represents solely a preferred embodiment and is not indicative of the nature of the invention as a whole.

Although the present invention has been described in detail, it will be apparent to those skilled in the art that many embodiments taking a variety of specific forms and reflecting changes, substitutions and alterations can be made without departing from the spirit and scope of the invention. For example, additional variations in the type, number and configuration of the blades, cutters, and discs can be made without departing from the spirit of the invention. The described embodiments illustrate the scope of the claims but do not restrict the scope of the claims.

What is claimed is:

1. A drill bit (100) for making a hole in a subterranean formation, comprising: a bit body defining a centerline axis (150) about which said bit body rotates while drilling; a first blade (110) fixed to said bit body defining a leading edge (112); a cutter disc (120) rotatably mounted to the first blade so as to rotate about a cutter disc axis (125) that does not lie within a plane that is radially oriented with respect to said centerline axis, that is substantially perpendicular to a radial of said centerline axis, and that is substantially perpendicular to the centerline axis; and a first plurality of cutters (140, 142) fixed to said cutter disc; wherein the cutter disc is configured to rotatably present the first plurality of cutters to the formation during drilling.

2. The drill bit of claim 1 further comprising: a second plurality of cutters (130) fixed to said first blade.

3. The drill bit of claim 1 wherein: at least one of the second plurality of cutters includes a cutting surface (134) having polycrystalline diamond compact.

4. The drill bit of claim 1 wherein: the cutter disc axis defines a mounting angle with respect to a plane defined by the leading edge of first blade, said mounting angle selected so as to generate a torque on the cutter disc during drilling, whereby the torque causes the cutter disc to rotate during drilling.

5. The drill bit of claim 4 wherein: said mounting angle is between 60 and 120 degrees.

6. The drill bit of claim 1 wherein: each of said first plurality of cutters defines a cutter axis (310) that is offset from said cutter disc axis (125) at an angle (315) in the range from 0 and 30 degrees.

7. The drill bit of claim 1 wherein: the cutter disk defines a planar cutter disk face (405); and the cutter disk face is disposed at a rake angle (485) with respect to said centerline axis within a range from −30 to 30 degrees.

8. A drag-type drill bit (100) for making a hole in a subterranean formation, comprising: a bit body defining a centerline axis (150) about which said bit body rotates while drilling; a plurality of blades (110) fixed to said bit body and designed and arranged to scrape the formation; a first cutter disc (120) rotatably mounted to a first of said plurality of blades so as to rotate about a first cutter disc axis (125) that intersects a first point lying within a first circumference at a first radial distance (850) from said centerline axis and lies within 30 degrees from a first line that is tangent to said first circumference at said first point and perpendicular to said centerline axis; and a first plurality of cutters (140, 142) fixed to said first cutter disc; wherein the first cutter disc is configured to rotatably present the first plurality of cutters to the formation during drilling.

9. The drag-type drill bit of claim 8 further comprising: a second cutter disc (520) rotatably mounted to a second of said plurality of blades so as to rotate about a second cutter disc axis (125) that intersects a second point lying within a second circumference at a second radial distance (860) from said centerline axis and lies within 30 degrees from a second line that is tangent to said second circumference at said second point and perpendicular to said centerline axis; and a second plurality of cutters (140, 142) fixed to said second cutter disc.

10. The drag-type drill bit of claim 9 wherein: said second radial distance equals said first radial distance.

11. The drag-type drill bit of claim 9 wherein: said second cutter disc has a diameter greater than said first cutter disc.

12. The drag-type drill bit of claim 8 wherein: said first cutter disc is located in a region from one the group consisting of a gauge region, a shoulder region, a nose region and a cone region of the drill bit.

13. The drill bit of claim 8 wherein: each of said first plurality of cutters defines a cutter axis (310) that is offset from said first cutter disc axis (125) at an angle (315) in the range from 0 and 30 degrees.

14. A drag-type drill bit (100) for making a hole in a subterranean formation, comprising: a bit body defining a centerline axis (150) about which said bit body rotates while drilling; a plurality of blades (110) fixed to said bit body and designed and arranged to scrape the formation; a first cutter disc (120) having a generally planar face and defining a cutter disc axis of rotation (125) normal to said planar face, said first cutter disc rotatably mounted to a first of said plurality of blades so that said planar face of said first cutter disc substantially faces the direction of travel as said bit body is rotated about said centerline axis.

15. The drag-type drill bit of claim 14 further comprising: a second cutter disc (120) having a generally planar face and rotatably mounted to a second of said plurality of blades so that said planar face of said second cutter disc substantially faces the direction of travel as said bit body is rotated about said centerline axis.

16. The drag-type drill bit of claim 14 wherein: each of said plurality of blades has a cutter disc (120) characterized by a generally planar face that is rotatably mounted to the blade so that the planar face substantially faces the direction of travel as the bit body is rotated about the centerline axis.

* * * * *